US005415107A

United States Patent [19]

Tutzauer

[11] Patent Number: 5,415,107

[45] Date of Patent: May 16, 1995

[54] RUNNING GEAR FOR DROP-FRAME RAIL VEHICLES

[75] Inventor: Rene Tutzauer, Freudenberg, Germany

[73] Assignee: ABB Henschel Waggon Union GmbH, Berlin, Germany

[21] Appl. No.: 90,590

[22] Filed: Jul. 12, 1993

[30] Foreign Application Priority Data

Nov. 11, 1991 [DE] Germany ..... 41 36 926.2

[51] Int. Cl.[6] ..... B61F 5/26

[52] U.S. Cl. ..... 105/218.2; 105/180

[58] Field of Search ..... 105/171, 180, 185, 199.1, 105/202, 218.2

[56] References Cited

U.S. PATENT DOCUMENTS

| | | | |
|---|---|---|---|
| 3,190,237 | 6/1965 | Hurtner | 105/218.2 |
| 3,884,157 | 5/1975 | Pelabon | 105/202 X |
| 4,459,919 | 7/1984 | Lemaire et al. | 105/199.1 X |
| 5,181,473 | 1/1993 | Petit et al. | 105/218.2 X |

FOREIGN PATENT DOCUMENTS

| | | | |
|---|---|---|---|
| 0129772 | 1/1985 | European Pat. Off. . | |
| 0271451 | 6/1988 | European Pat. Off. . | |
| 0384512 | 8/1990 | European Pat. Off. . | |
| 2345330 | 10/1977 | France . | |
| 2442167 | 6/1980 | France . | |
| 1405596 | 10/1968 | Germany . | |
| 3538513 | 5/1987 | Germany . | |
| 194630 | 3/1938 | Switzerland | 105/218.2 |

*Primary Examiner*—Robert J. Oberleitner
*Assistant Examiner*—S. Joseph Morano
*Attorney, Agent, or Firm*—Herbert L. Lerner; Laurence A. Greenberg

[57] ABSTRACT

A running gear for drop-frame rail vehicles includes a running-gear frame on which individual wheels are each rotatably mounted through a respective rocker and the rocker is fastened in an articulated manner and supported through primary springs. The connection of the running-gear frame to the carriage body of the drop-frame rail vehicle is provided through two articulated rods which are mounted on a crossmember of the running gear frame and which are fastened to the carriage body. The carriage body is supported on the running-gear frame through secondary springs which are mounted in pockets of the transverse ends of the crossmembers. Transverse stops which are disposed in the crossmember limit the transverse movement of the carriage body in relation to the running gear. Advantageously, the individual wheel and the drive of the individual wheel are mounted in the rocker in such a manner as to be connected to form a structural unit. This structure provides running gears for drop-frame rail vehicles in which the drop-frame nature of the carriage body is completely preserved and only wheel cases are present in the region of the individual wheels of the running gear.

5 Claims, 3 Drawing Sheets

RUNNING GEAR FOR DROP-FRAME RAIL VEHICLES

CROSS-REFERENCE TO RELATED APPLICATION

This application is a Continuation of International Application Serial No. PCT/EP92/02490, filed Oct. 30, 1992.

BACKGROUND OF THE INVENTION

FIELD OF THE INVENTION

The invention relates to a running gear for drop-frame rail vehicles, having a running-gear frame on which individual wheels are rotatably mounted through a respective rocker and in which the rocker is fastened in an articulated manner and is supported through primary springs.

Such a running gear is known from Published European Application No. 0 384 512 A. In that structure, the frame of the running gear is made approximately H-shaped with double crossmembers. The double crossmembers are connected to one another at their transverse ends by means of outer longitudinal members which project slightly beyond the double crossmembers in the longitudinal direction of the running gear. A vertically and horizontally transversely movable bolster crossmember is disposed between the double crossmember. The bolster crossmember is suspended at its transverse ends through floating axles in secondary springs which are supported on the outer longitudinal members of the running gear. The bolster crossmember centrally carries a receptacle for the pivot pin of the carriage body. On both sides of the receptacle of the pivot pin, abutments are provided on the bolster crossmember in the transverse direction of the running gear, through which the carriage body is supported on bends. The outer longitudinal members of the running-gear frame carry individual wheels near their longitudinal ends on rockers, with the rockers being mounted in an articulated manner on the outer longitudinal members, and the rockers being supported relative to one another and on the running-gear frame through primary springs.

One disadvantage of the above-mentioned structure is the configuration of a bolster crossmember and its suspension on the secondary springs which, on one hand, constitutes a structure involving a high outlay and, on the other hand, necessitates such a large structural height in the region between the individual wheels of one longitudinal side of the running gear that the drop-frame nature of the drop-frame rail vehicle is considerably impaired, at least in that region, and transverse seats cannot be disposed. A further disadvantage of that previously known construction is that, because the running gear is guided on the carriage body by means of a pivot pin, it is necessary, for use on drop-frame rail vehicles, to have additional sway dampers which reduce the efficiency of the running gear.

Moreover, running gears having individual wheels are known from Published European Application No. 0 129 772. In that running gear, the individual wheels are likewise mounted on the frame of the running gear through rockers. However, the running gear of that prior publication has such a high construction, at least in the region between the wheels of one longitudinal side of the running gear, that it cannot be employed for drop-frame rail vehicles with a continuous carriage floor. Furthermore, individual wheels for running gears for rail transport are known per se from German Published, Non-Prosecuted Application DE 35 38 513 A. In that prior publication, the individual wheels are suspended on the carriage body through rockers.

Furthermore, rockers for the articulation of wheel axles for rail transport, in which the rockers are supported on the truck or bogie frame through springs, are known from practice.

SUMMARY OF THE INVENTION

It is accordingly an object of the invention to provide a running gear for drop-frame rail vehicles, which overcomes the hereinafore-mentioned disadvantages of the heretofore-known devices of this general type, in which the drop-frame nature of the carriage body is completely preserved and in which there are only wheel cases in the region of the wheels of the running gear, which project into the carriage body and which are disposed under seats in such a way that the carriage floor can be made continuous.

With the foregoing and other objects in view there is provided, in accordance with the invention, in a drop-frame rail vehicle having a carriage body, a running gear comprising a running-gear frame having a crossmember, the crossmember having transverse ends with pockets formed therein; rockers articulatingly fastened to the crossmember, primary springs each supporting a respective one of the rockers on the crossmember, individual wheels each being rotatably mounted in a respective one of the rockers; two articulated rods each having one end being articulatingly mounted at a distance from one another on the crossmember and another end to be articulatingly fastened to the carriage body, for connecting the running-gear frame to the carriage body; secondary springs mounted in the pockets for supporting the carriage body on the running-gear frame; and transverse stops disposed at a distance from one another in the crossmember for limiting transverse movement of the carriage body relative to the running gear.

In accordance with another feature of the invention, the rocker is constructed in the form of an angle lever which is double-armed, one end of the rocker engages on both sides around short brackets pointing in the longitudinal direction of the running gear at the transverse ends of the crossmember of the truck or bogie frame and is mounted there in an articulated manner, a middle end of the rocker engages on both sides around the individual wheel and carries the axle of the latter, and at a third end of the rocker its two arms are connected to one another and bear against the primary spring.

In accordance with a further feature of the invention, there is provided a bracket forming the abutment for the primary spring which is disposed on the crossmember of the running gear for each rocker. Since the running gear is constructed in this way according to the invention, both the region between the individual wheels in the transverse direction of the running gear and the region between the individual wheels of one longitudinal side of the running gear are kept free of elements with a high construction. The carriage body of the drop-frame rail vehicle can thus be made continuous, with the exception of the wheel cases, and without disturbing steps.

In accordance with an added feature of the invention, the individual wheel and a drive of the individual wheel are mounted in the rocker and connected to form a structural unit.

In accordance with an additional feature of the invention, a brake of the individual wheel is likewise mounted on the rocker and is constructed to act as a block brake or disc brake on the housing of the drive. As a result of this construction of the individual wheel and its drive as a structural unit which can be used at the same time as an abutment for the brake, components which have a high construction and which therefore disturb the drop-frame nature of the carriage body are likewise avoided.

In accordance with a concomitant feature of the invention, the articulated rods of the running gear are spherically mounted. As a result of this spherical mounting, the transverse movements of the carriage body in relation to the running gear which are limited by the transverse stops are transmitted into the running gear in a fault-free manner.

Other features which are considered as characteristic for the invention are set forth in the appended claims.

Although the invention is illustrated and described herein as embodied in a running gear for drop-frame rail vehicles, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
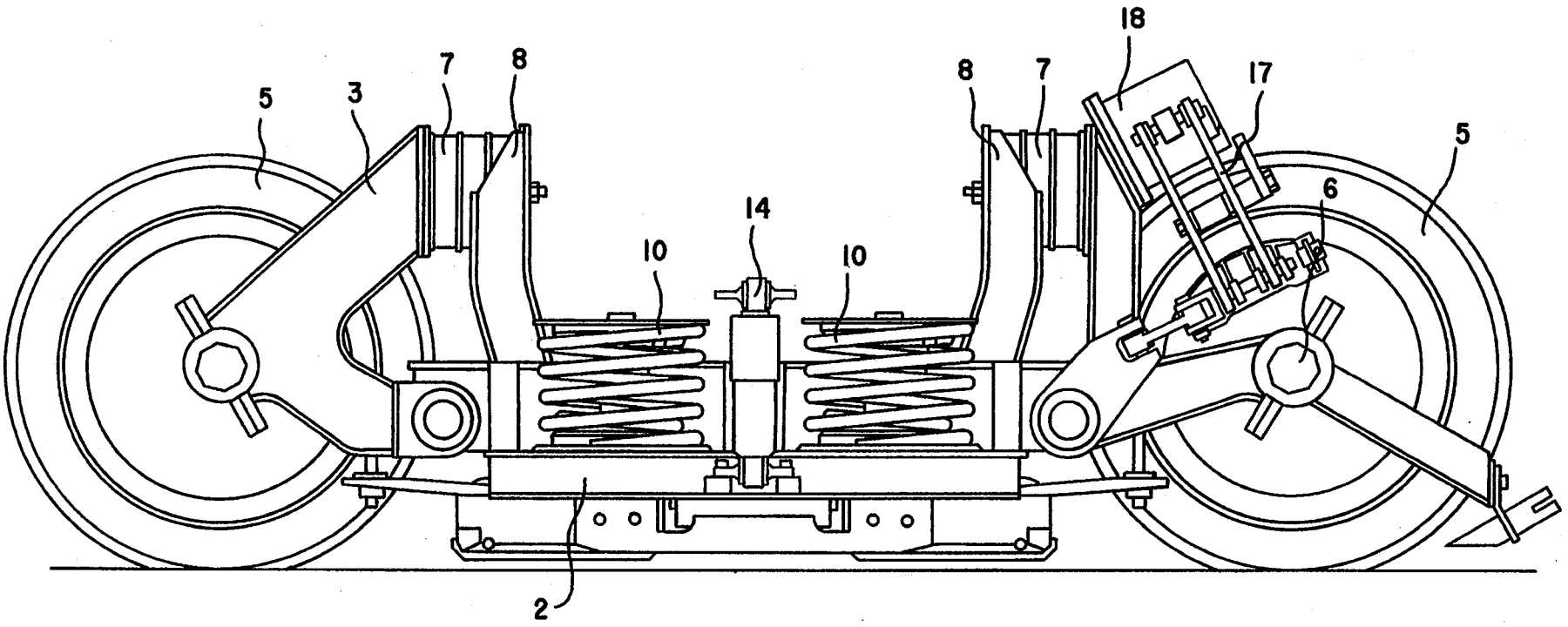
FIG. 1 is a side-elevational view of a running gear according to the invention.
Figure 2:
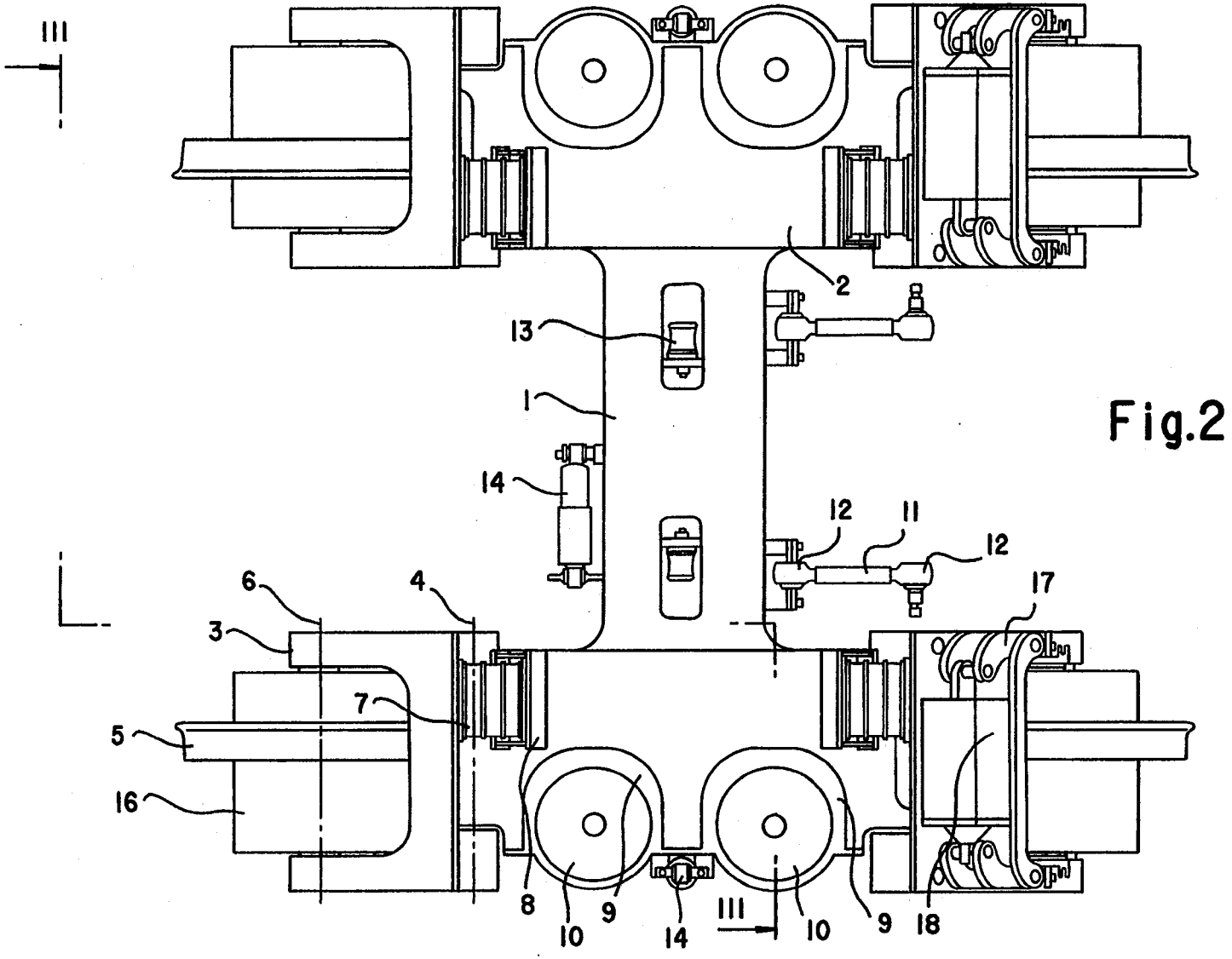
FIG. 2 is a top-plan view of the running gear according to FIG. 1.
Figure 3:
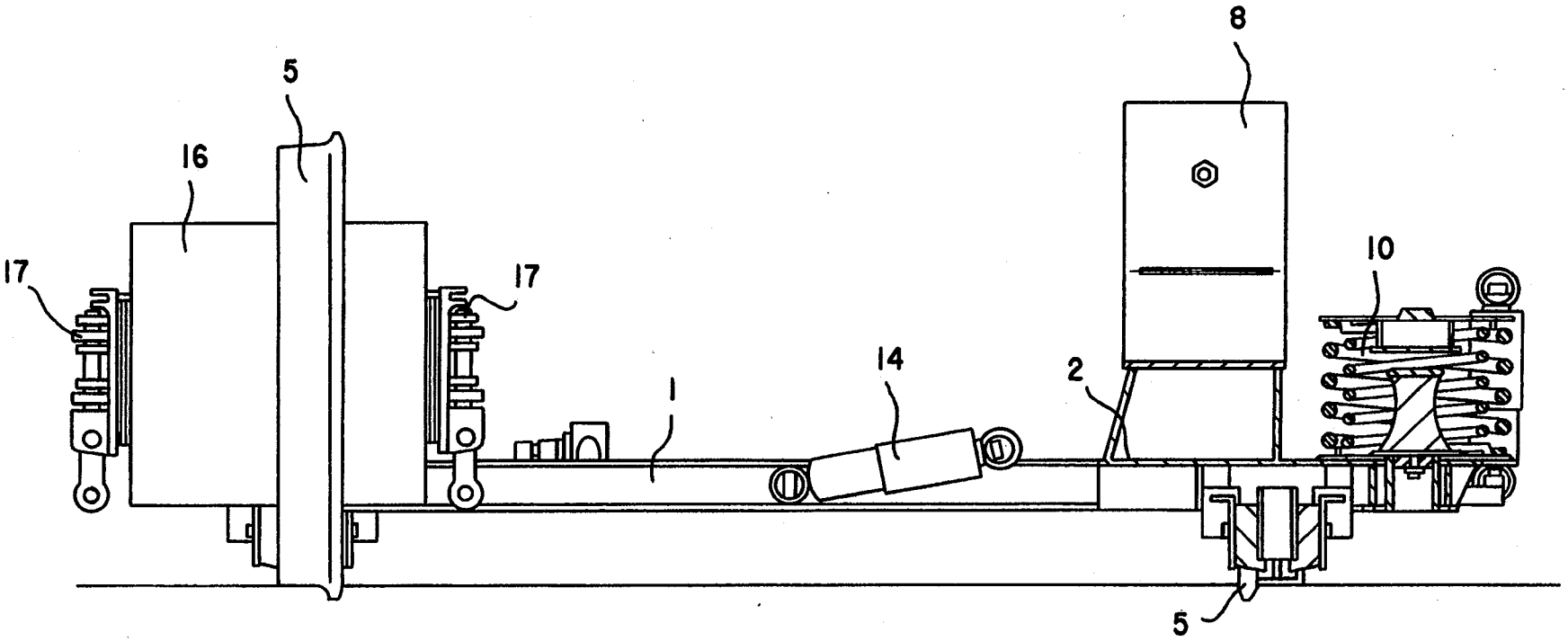
FIG. 3 is a sectional view taken along a line III—III of FIG. 2, in the direction of the arrows.

Referring now in detail to the figures of the drawing as a whole, there is seen a frame of a running gear according to the invention which is formed essentially of a crossmember 1. As is shown in the drawing, the crossmember 1 can be constructed as a single member or, according to a non-illustrated exemplary embodiment as a double crossmember. Short brackets 2 pointing in the longitudinal direction of the vehicle are disposed at transverse ends of the crossmember 1. The crossmember 1 and the brackets 2 have a flat construction in a box structure. Each bracket 2 carries a respective rocker 3 at its free end. This rocker 3 is in the form of an angle lever and is made double-armed. A first end of the rocker 3 engages on both sides around the bracket 2 and is mounted on the latter in an articulated manner through a joint 4. A second or middle or end of the rocker 3 engages on both sides around an individual wheel 5 which has an axle 6 that is fastened in the rocker 3. According to an alternative exemplary embodiment, the axle 6 can be mounted rotatably in the rocker 3. At a third end of the rocker 3, its two arms are connected to one another and are supported against a primary spring 7 which is fastened to a bracket 8 disposed on the upper surface of the crossmember 1. The bracket 8 is constructed in such a way in its horizontal extension that a projected area of the primary spring 7 is only slightly exceeded.

In the transverse middle of the running gear, pockets 9 are formed externally in the crossmembers 1 and receive a secondary spring 10 that is constructed as a pneumatic or helical spring.

A non-illustrated carriage body, which is formed in the region of the running gear of a short running-gear module connected in an articulated manner to passenger modules, is supported vertically on the secondary springs of the running gear. Articulated rods 11 have one end that is fastened to the crossmember 1 of the frame of the running gear at a distance from one another in an articulated manner, and another end which is attached at the carriage body in a likewise articulated manner. Bearings 12 of the articulated rods 11 are made spherical. Furthermore, in the transverse middle of the running gear, transverse stops 13 are provided at a distance from one another in the crossmember 1. These transverse stops 13 cooperate with corresponding abutments of the carriage body and limit transverse deflection of the carriage body in relation to the running gear. Shock absorbers 14, that are fastened at one end to the crossmember 1 of the frame of the running gear and at the other end to the carriage body, serve for improving the running behavior.

In the exemplary embodiment of the invention shown in the drawing, the individual wheels 5 are mounted rotatably on the axles 6 of the rockers 3. An individual wheel 5 is connected to a drive 16 thereof to form a structural unit and is mounted rotatably on the axle 6 of the rocker 3. According to the invention, the drive 16 can be formed of a direct drive or of a motor with a following transmission. Furthermore, a brake linkage 17, which is constructed in the exemplary embodiment as a disc brake and has a brake cylinder 18, is mounted on the rocker 3. The brake 17, 18 acts directly on a correspondingly constructed housing of the drive 16.

According to another non-illustrated exemplary embodiment of the invention, the brake 17, 18 can also be constructed as a block brake acting on a casing of the drive 16 or the individual wheel 5.

As is evident from the drawing, the running gear according to the invention is connected to the carriage body in such a way as to be vertically movable counter to a spring force, but virtually rigid horizontally and fixed in terms of rotation. The above-described connection guarantees a sway-free running of a drop-frame rail vehicle being formed of a plurality of running-gear and passenger modules.

I claim:

1. In a drop-frame rail vehicle having a carriage body, a running gear comprising:

a running-gear frame having a crossmember, said crossmember having transverse ends with pockets formed therein;

rockers articulatingly fastened to said crossmember, primary springs each supporting a respective one of said rockers on said crossmember, individual wheels each being rotatably mounted in a respective one of said rockers;

two articulated rods each having one end being articulatingly mounted at a distance from one another on said crossmember and another end to be articulatingly fastened to the carriage body, for connecting the running-gear frame to the carriage body;

secondary springs mounted in said pockets for supporting the carriage body on said running-gear frame; and transverse stops disposed at a distance from one another in said crossmember for limiting transverse movement of the carriage body relative to the running gear, wherein said wheels have axles, said transverse ends of said crossmember each have a short bracket pointing in the longitudinal direction of the running gear, and each of said rockers is a double-armed angle lever having a first end engaging on both sides around and being articulatingly mounted to a respective one of said short brackets, a second middle end engaging on both sides around a respective one of said wheels and carrying a respective one of said axles, and a third end having two interconnected arms bearing against a respective one of said primary springs.

2. The running gear according to claim 1, including brackets each being disposed on said crossmember and forming an abutment for a respective one of said primary springs for said rockers.

3. The running gear according to claim 1, including drives each being mounted in a respective one of said rockers and connected with a respective one of said wheels to form a structural unit.

4. The running gear according to claim 3, wherein said drives have housings, and including disc brakes for said wheels each being mounted on a respective one of said rockers and each acting on said housing of a respective one of said drives.

5. The running gear according to claim 1, wherein said articulated rods are spherically mounted.

* * * * *